US010603560B2

(12) United States Patent
Poetter

(10) Patent No.: US 10,603,560 B2
(45) Date of Patent: Mar. 31, 2020

(54) INTERCHANGEABLE GAMEBOARDS

(71) Applicant: Brian Edmund Poetter, Lowell, IN (US)

(72) Inventor: Brian Edmund Poetter, Lowell, IN (US)

( * ) Notice: Subject to any disclaimer, the term of this patent is extended or adjusted under 35 U.S.C. 154(b) by 0 days.

(21) Appl. No.: 15/162,695

(22) Filed: May 24, 2016

(65) Prior Publication Data

US 2017/0340937 A1 Nov. 30, 2017

(51) Int. Cl.
*A63B 67/06* (2006.01)
*A63B 71/06* (2006.01)

(52) U.S. Cl.
CPC ..... *A63B 67/06* (2013.01); *A63B 2067/061* (2013.01); *A63B 2071/0694* (2013.01); *A63B 2210/50* (2013.01)

(58) Field of Classification Search
CPC ..... A63B 67/06; A63B 63/00
See application file for complete search history.

(56) References Cited

U.S. PATENT DOCUMENTS 3,235,118 A * 2/1966 Kewley ..... A45C 5/04 217/12 R
2013/0082442 A1* 4/2013 Hanel ..... A63B 63/00 273/398

OTHER PUBLICATIONS https://www.craftsy.com/blog/2014/11/how-to-make-a-wooden-box-with-a-sliding-lid/ Author: Wilbur Pan; Date: Nov. 15, 2014.*

* cited by examiner

*Primary Examiner* — Jeffrey S Vanderveen
(74) *Attorney, Agent, or Firm* — Christopher Mayle; John D. Houvener; Bold IP, PLLC

(57) ABSTRACT

A cornhole game board providing an interchangeable faceplate display is provided. The game board includes a framework having a plurality of peripheral elements defining an opening into which a faceplate may be inserted. Each peripheral element may define a portion of a coplanar slot extending along the game board framework, wherein one of a plurality of faceplates may be slidably received or removed in the resulting coplanar slot. Thereby the game board provides a variety of interchangeable playing surfaces of cornhole.

12 Claims, 4 Drawing Sheets

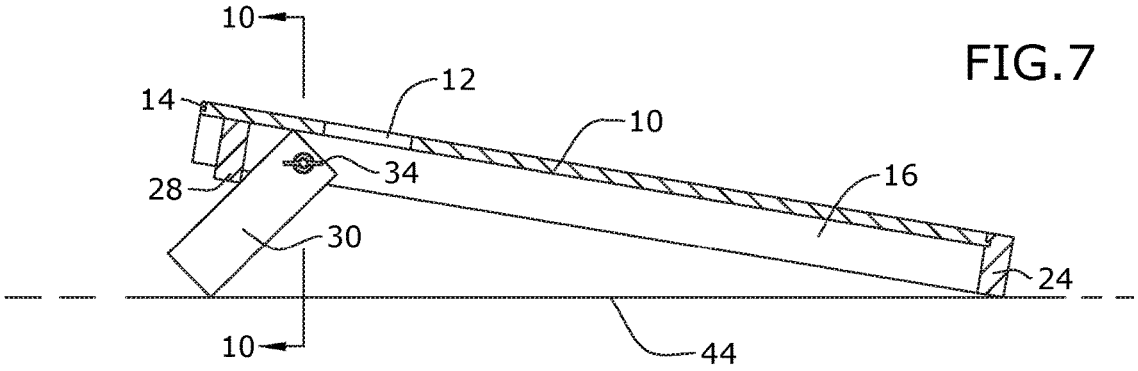
FIG.7
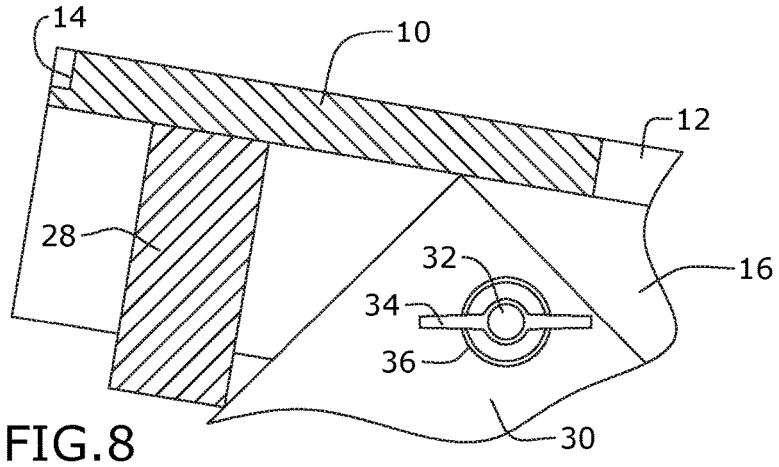
FIG.8
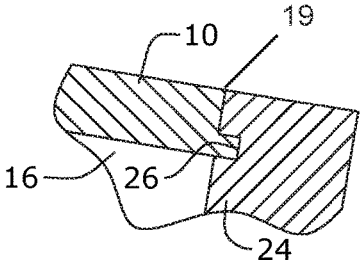
FIG.9
FIG.10
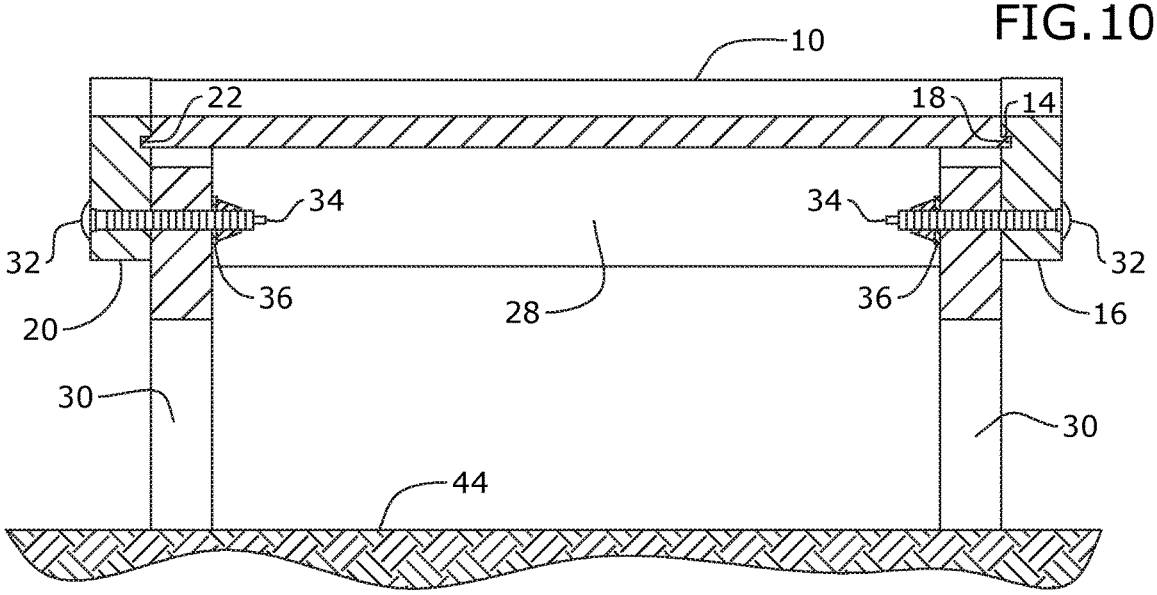

INTERCHANGEABLE GAMEBOARDS

BACKGROUND OF THE INVENTION

The present invention relates to interchangeable game boards and, more particularly, a cornhole game board adapted to slidably receive interchangeable faceplates.

The game of cornhole, also known as dummy boards, bean bag toss, and other names is an American lawn game in which players take turns throwing bags of corn at a raised platform with a hole in the far end, scoring points for getting a bag in the hole or to land and stay on the platform. Current cornhole game boards have a static and permanent platform or "playing surface," and thus they lack the ability to change designs on the playing surface without completely deconstructing the actual board. Thus, if a playing surface becomes worn, warped, or weathered, a user cannot replace the playing surface without purchasing an entirely new game board. Similarly, if a user follows multiple teams or otherwise would like multiple designs on their playing surface, they would need to have multiple game boards, which would consume both money and storage space.

As can be seen, there is a need for a game board frame adapted to slidably receive interchangeable faceplates for providing a variety of playing surfaces, effectively utilizing only one game board frame to do so.

SUMMARY OF THE INVENTION

In one aspect of the present invention, a cornhole game board includes two spaced apart longitudinal elements; a base element interconnecting the two longitudinal elements so as to define an opening, wherein the base element is connected near a respective first end of each of the two longitudinal elements; a longitudinal slot provided by each of the two longitudinal elements so that the longitudinal slots are coplanar; a plurality of faceplates, each dimensioned and adapted to slide into the longitudinal slots so as to be substantial visible through the opening; and a cornhole provided by each faceplate.

In another aspect of the present invention, the cornhole game board, includes two spaced apart longitudinal elements; a base element interconnecting the two longitudinal elements so as to define an opening, wherein the base element is connected near a respective first end of each of the two longitudinal elements; a top element interconnecting the two longitudinal elements near a respective second end of each of the two longitudinal elements; a longitudinal slot provided by each of the two longitudinal elements; a base slot provided by the base element so that the base slot is coplanar with the longitudinal slots; a leg provided by each of longitudinal elements for propping up a respective second end of each of the two longitudinal elements; a plurality of faceplates, each dimensioned and adapted to slide into the longitudinal slots so as to be substantial visible through the opening; a dado along a portion of a periphery of each faceplate; a cornhole provided by each faceplate; and at least one corn bag dimensioned to be received through the cornhole.

These and other features, aspects and advantages of the present invention will become better understood with reference to the following drawings, description and claims.

BRIEF DESCRIPTION OF THE DRAWINGS

FIG. 7 is a section view of an exemplary embodiment of the present invention, taken along 7-7 in FIG. 1;

FIG. 8 is an enlarged section view of an exemplary embodiment of the present invention;

FIG. 9 is an enlarged section view of an exemplary embodiment of the present invention; and FIG. 10 is a section view of an exemplary embodiment of the present invention, taken along 10-10 in FIG. 7.

DETAILED DESCRIPTION OF THE INVENTION

Figure 1:
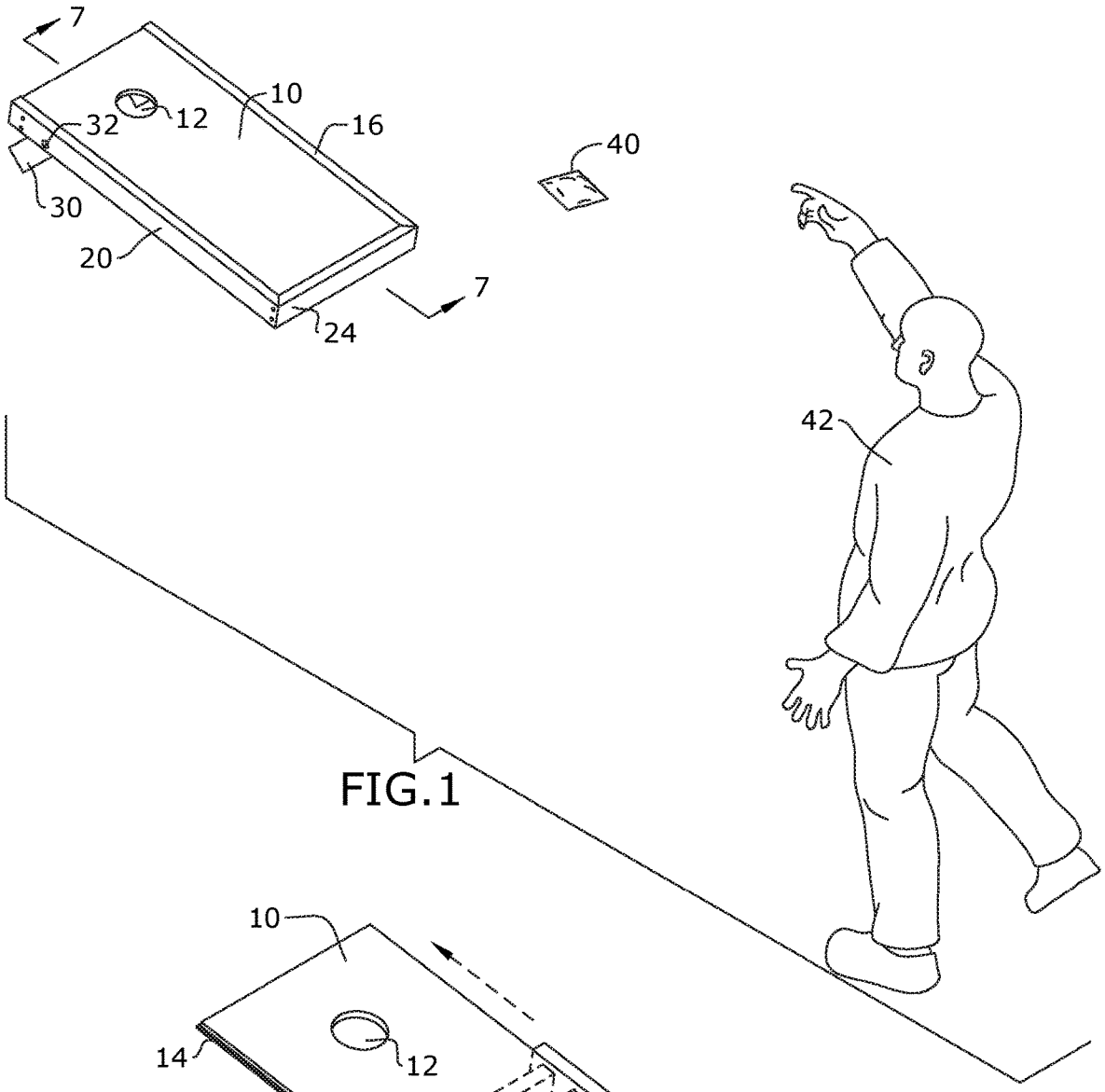
FIG. 1 is a perspective view of an exemplary embodiment of the present invention, shown in use.
Figure 2:
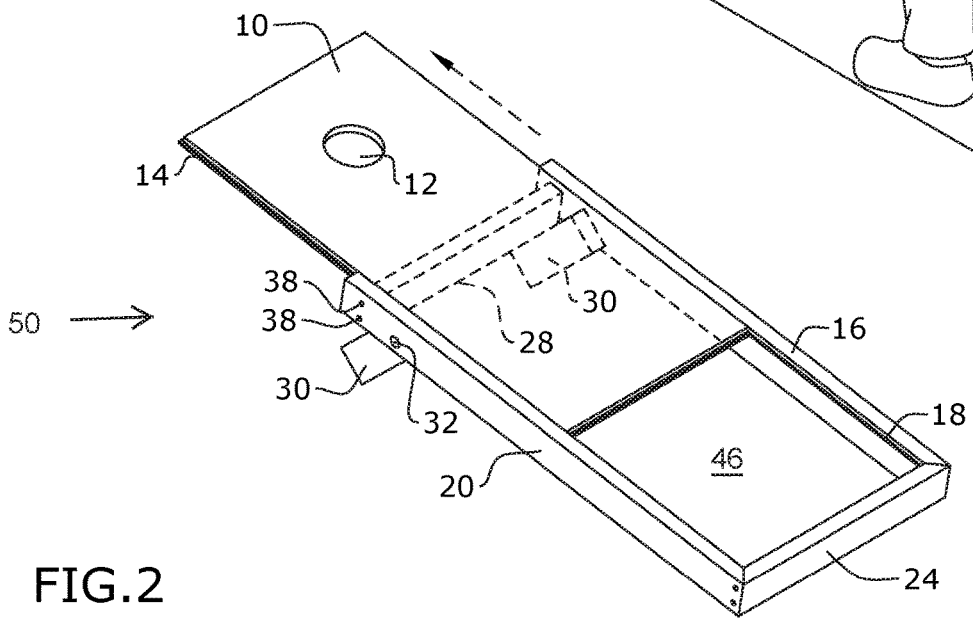
FIG. 2 is a perspective view of an exemplary embodiment of the present invention, illustrating a faceplate being removed.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention may include a cornhole game board providing an interchangeable faceplate display. The game board includes a framework having a plurality of peripheral elements defining an opening into which a faceplate may be inserted. Each peripheral element may define a portion of a coplanar slot extending along the game board framework, wherein one of a plurality of faceplates may be slidably received or removed in the resulting coplanar slot. Thereby the game board provides a variety of interchangeable playing surfaces of cornhole.

Referring now to FIGS. 1 through 10, the present invention may include a cornhole game board 50 providing interchangeable faceplate 10 capabilities. The game board 50 may provide a framework 48 having a plurality of peripheral elements defining an opening 46 into which one of a plurality of faceplates 10 may be inserted. The plurality of peripheral elements may include a pair of opposing longitudinal elements 24, 20 and a base element 24 interconnecting opposing ends of the longitudinal elements 24, 20. The base element 24 and the longitudinal elements 24, 20 may be contiguous to each other so as to define a substantially coplanar peripheral inner edge 19 defining the opening 46. The plurality of peripheral elements may be made of cardboard, plastic, wood, various fibrous materials or the like.

In certain embodiments, the plurality of peripheral elements may include a top element 28 interconnect to the opposing longitudinal elements 24, 20 on an end opposing the base element 24. The top element 28 may be adapted to provide lateral support for the opposing longitudinal elements 24, 20. The interconnections of the plurality of peripheral elements may be done by way of fasteners 38. The plurality of peripheral elements may form a parallelogram shape, as illustrated in the Figures, however any shape that functions in accordance with the disclosure herein is also sufficient.

Each peripheral element may define a portion of a coplanar slot 18, 22, 26 extending approximately the entire length of a periphery of the opening 46, as illustrated in FIGS. 9 and 10. The portions of the coplanar slot 18, 22, 26 in their totality provide a coplanar slot or groove for slidably receiving at least one faceplate 10. In certain embodiments, the coplanar slot may be formed by portions 18, 22 of the opposing longitudinal elements 24, 20. The resulting coplanar slot may be adapted so that each faceplate 10 can be slidably received so as to be visible through the opening 46. The top element 28 may be disposed downward (relative to the supporting surface 44) from the peripheral inner edge 19 so that the faceplate 10 slides over the top element 28.

The faceplate 10 may provide a peripheral dado 14 to facilitate the sliding reception within the coplanar slot. The faceplate 10 may have a design, messages, imagery or the like that a user 42 may wish to display, for example of a logo of the user's favorite sports team. The faceplate 10 may form at least one cornhole 12. In certain embodiments, the at least one cornhole 12 may be adapted to receive at least one corn bag 40 thrown by the user 42 when playing the cornhole game, as illustrated in FIG. 1.

Figure 3:
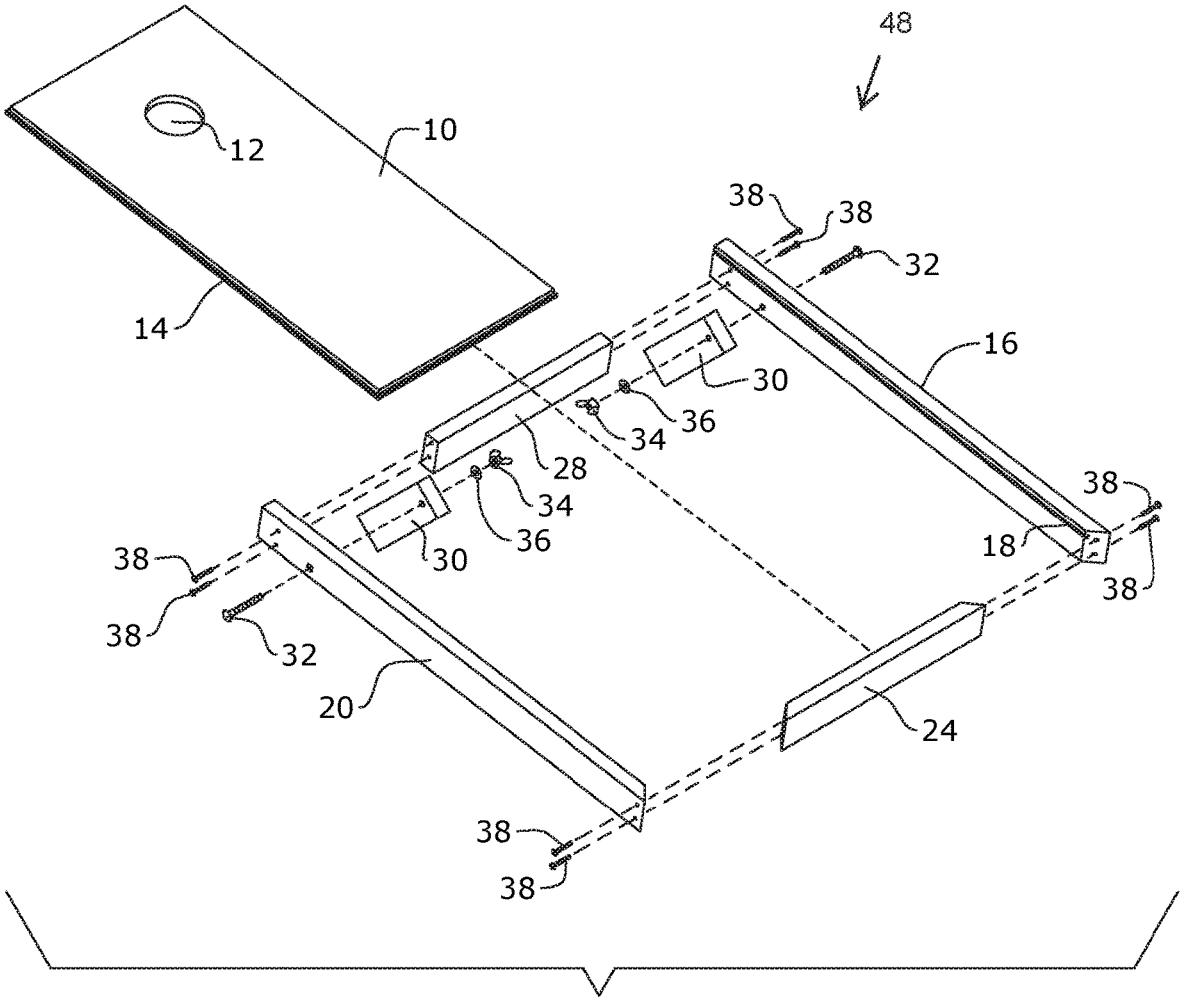
FIG. 3 is an exploded view of an exemplary embodiment of the present invention.
Figure 4:
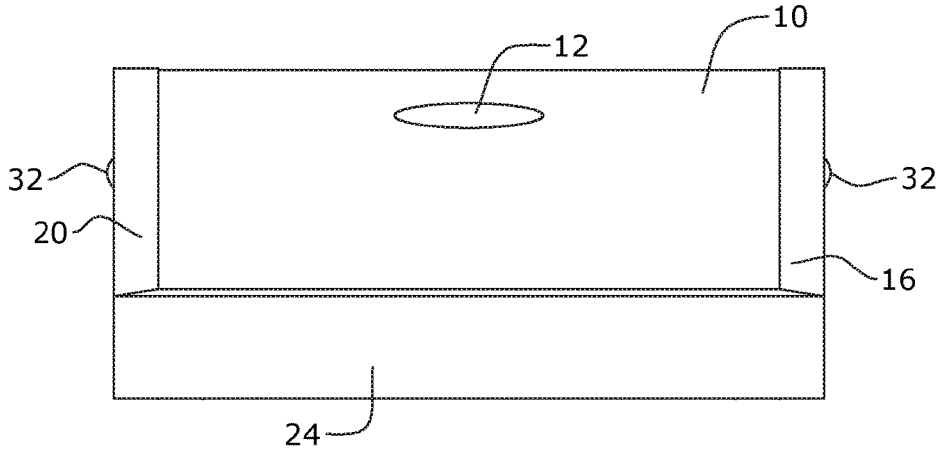
FIG. 4 is a front elevation view of an exemplary embodiment of the present invention.
Figure 5:
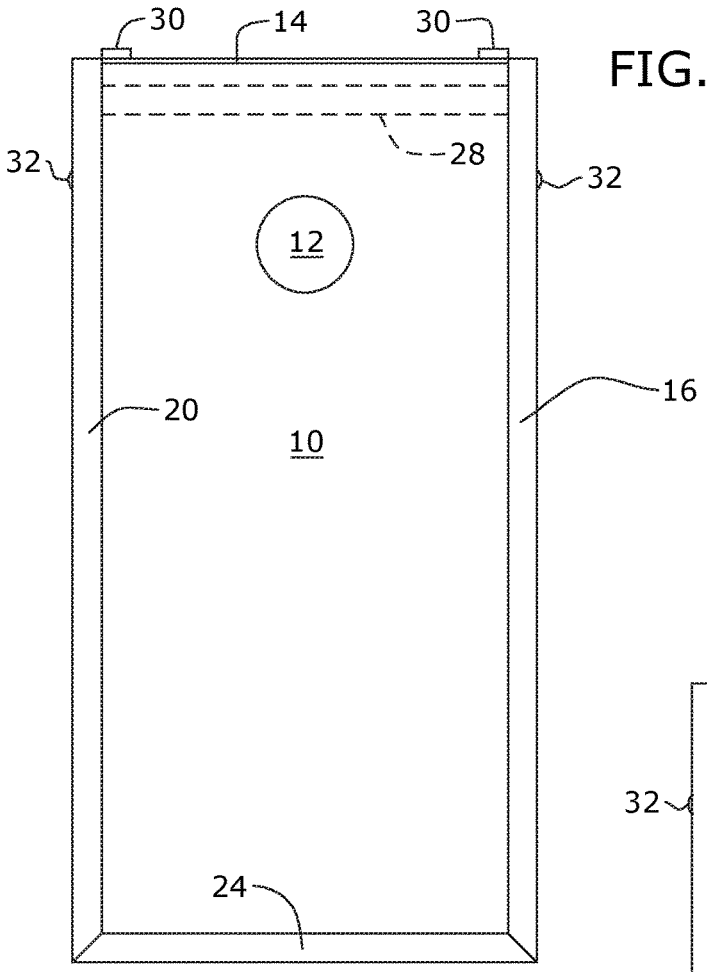
FIG. 5 is a top plan view of an exemplary embodiment of the present invention.
Figure 6:
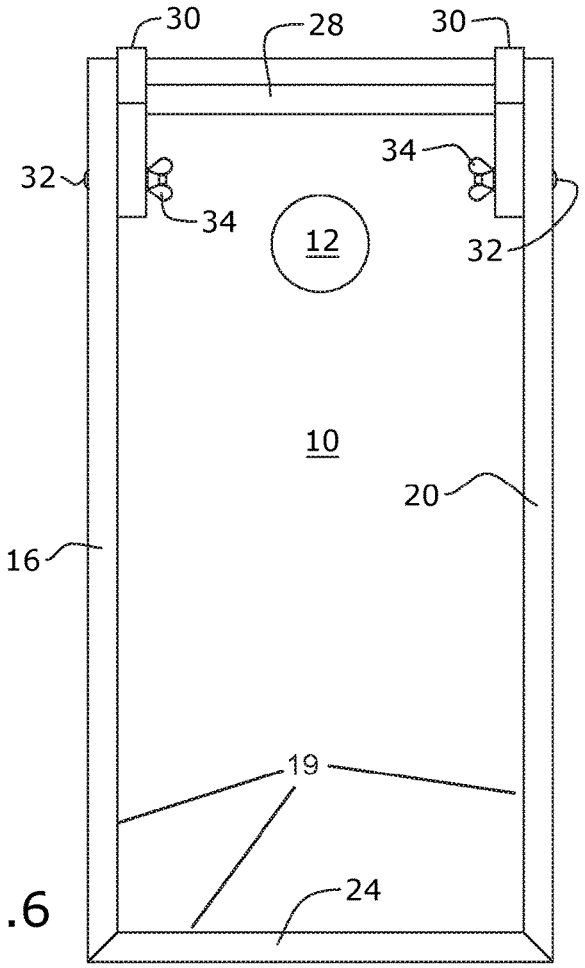
FIG. 6 is a bottom plan view of an exemplary embodiment of the present invention.

The framework 48 may include a leg 30 connected to the each of the pair of the opposing longitudinal elements 16, 20 so as to prop up one end the framework 48 so that the faceplate 10 is oriented at an acute angle relative to a ground surface 44 supporting the framework 18, as illustrated in FIG. 7. Each leg 30 may be connected to each longitudinal/peripheral element 16, 20 by way of fasteners 32, 34, 36, so as to be pivotally connected thereto, as illustrated in FIG. 3. The leg(s) 30 may be alternatively attached to the top element 28.

A method of making the present invention may include the following. An individual may provide equipment comprising two 48" 2×4's, two 24" 2×4's, and a 23"×46" piece of plywood. It may also be necessary to have a dado blade to make the cuts forming the coplanar slot or portions thereof. The initial step may include cutting the two 48" pieces of 2×4 and two 24" pieces of 2×4. Then the individual may then run a ⅝" dado cut, ¼" from the top of the 2×4, along the inside of every piece of wood at a depth of ¾". The individual may then screw the 48" pieces to one of the 24" pieces to make a "U" shape with the dado cuts lining up. A 21" piece of 2×4 may be installed at the open end of the "U" so create the framework 48. To make a faceplate 10, the individual may then take a 19/32" thick piece of plywood and cut it to measure 23"×46". You must run a ⅝" dado at ¼" deep along the inside perimeter of the plywood. You will be able to insert the faceplate 10 into the framework 48 by sliding it in the top of the "U".

In certain embodiments, the individual make manufacture the interchangeable faceplate display 10 by the following:

Cut (4) 2×4's into a 4' piece;
Cut (4) 2×4's into a 2' piece;
Run a ⅝;
Cut a 45 degree angle on opposite ends of the pieces of wood;
Screw 2 of the 4' pieces to one of the 2' pieces, with the dado cut up;
Screw a 21;
Cut a 21;
Run a ⅝;
Measure 9;
Slide in plywood to the frame;
Drill a ½;
Insert a 4;
Cut a (2)10.5;
Drill a ¼;
Slide 10.5;
Slide the last 2' piece onto the top of the set;
Drill a ¼; and
Run a 6

A method of using the present invention may include the following. The cornhole game board 50 disclosed above may be provide. A user may slide a first faceplate 10 into the coplanar slots 18, 22 provided by the framework 48 so as to display the first faceplate 10 through the opening 46. Then, when the user wants a different display, the user may slidably remove the first faceplate 10 so as to exchange it with a second faceplate 10, whereby the second faceplate 10 is slidably received in the coplanar slots 20. Then the user may play the game cornhole.

It should be understood, of course, that the foregoing relates to exemplary embodiments of the invention and that modifications may be made without departing from the spirit and scope of the invention as set forth in the following claims.

What is claimed is:

1. A cornhole gameboard, comprising:

two spaced apart longitudinal elements, said two spaced apart longitudinal elements each having a vertex at a first end of both longitudinal elements;

a base element comprising two ends each having a vertex that are obliquely opposed to both longitudinal element's first ends, said obliquely opposed vertexes interconnecting the two longitudinal elements so as to define an opening, wherein the two base element ends are each independently connected near the respective first ends of each of the two longitudinal elements as to form two obliquely opposed vertex connections;

a longitudinal slot provided by each of the two longitudinal elements so that the longitudinal slots are coplanar;

a plurality of faceplates, each of said faceplates having at least one corn hole that passes from a top surface to a bottom surface and each of said faceplates dimensioned and adapted with a dado along a first and a second side to slide into the longitudinal slots so as to be substantially visible through the opening, wherein said dado is configured to facilitate the sliding reception within the coplanar slots of said plurality of faceplates having at least one cornhole; and a top element, the element opposing the base element, the top element comprising two ends configured to provide lateral support for the longitudinal elements, the top element disposed downward such that that the plurality of faceplates is configured to slide over the top element;

at least one corn bag, wherein said at least one cornhole provided by each plurality of faceplates are configured to allow passage of said at least one corn bag from said top surface to a ground surface;

a base slot provided by the base element so that the base slot is coplanar with the longitudinal slots;

the two spaced apart longitudinal elements each having a 45-degree vertex at the first end of both longitudinal elements;

the two ends of the base end each having a 45-degree vertex;

a leg connected to each of the longitudinal elements configured for propping up a respective second end of each of the two longitudinal elements off of the ground surface;

the legs connected to each of the longitudinal elements, when parallel with the ground surface, configured to be positioned in a recess created by the top element, the longitudinal elements, and the faceplate, the top element when in this position configured to be in contact with the ground surface, the legs when in this position configured to not be in contact with the ground surface.

2. The gameboard of claim 1, further comprising: legs connected to the top element configured for propping up the gameboard.

3. The gameboard of claim 1, the top element having a top surface and bottom surface, the bottom surface of the top element extending below the base element and longitudinal elements when the bottom surface is parallel with the ground surface, the base component extending above the top surface of the top element when the top element is parallel with the ground surface.

4. A cornhole gameboard, comprising:

two spaced apart longitudinal elements, said two spaced apart longitudinal elements each having a 45 degree vertex at a first end of both longitudinal elements;

a base element comprising two ends each having a 45 degree vertex that are obliquely opposed to both longitudinal element's first ends, said obliquely opposed vertexes interconnecting the two longitudinal elements so as to define an opening, wherein the base elements two ends are each independently connected near the respective first ends of each of the two longitudinal elements as to form two obliquely opposed vertex connections;

a longitudinal slot provided by each of the two longitudinal elements so that the longitudinal slots are coplanar;

a plurality of faceplates, each of said faceplates having at least one cornhole that passes from a top surface to a bottom surface and each of said faceplates dimensioned and adapted with a dado along a first and a second side to slide into the longitudinal slots so as to be substantially visible through the opening, wherein said dado is configured to facilitate the sliding reception within the coplanar slots of said plurality of faceplates having at least one cornhole; and a top element comprising two ends configured to provide lateral support for the longitudinal elements, the top element disposed downward such that that the plurality of faceplates are configured to slide over the top element, the top element having a top surface and bottom surface, the bottom surface of the top element extending below the longitudinal elements and the base component when bottom surface is parallel with the ground surface, the base element extending above the top of the top element when the top element is parallel with the ground surface;

at least one corn bag, wherein said at least one cornhole provided by each plurality of faceplates are configured to allow passage of said at least one corn bag from said top surface to a ground surface;

a base slot provided by the base element so that the base slot is coplanar with the longitudinal slots;

the two spaced apart longitudinal elements each having a 45-degree vertex at the first end of both longitudinal elements;

the two ends of the base end each having a 45-degree vertex;

a leg connected to each of the longitudinal elements configured for propping up a respective second end of each of the two longitudinal elements off of the ground surface;

the legs connected to each of the longitudinal elements, when parallel with the ground surface, configured to be positioned in a recess created by the top element, the longitudinal elements, and the faceplate, the top element when in this position configured to be in contact with the ground surface, the legs when in this position configured to not be in contact with the ground surface.

5. The gameboard of claim 4, further comprising a base slot provided by the base element so that the base slot is coplanar with the longitudinal slots.

6. The gameboard of claim 5, further comprising: at least one corn bag, wherein said at least one cornhole provided by each plurality of faceplates are configured to allow passage of said at least one corn bag from said top surface to a ground surface.

7. The gameboard of claim 6, further comprising: a leg provided by each of said two longitudinal elements configured for propping up a respective second end of each of the two longitudinal elements off of the ground surface.

8. The gameboard of claim 7, further comprising: legs connected to the top element configured for propping up the gameboard.

9. A method of changing a faceplate for a cornhole gameboard, the method comprising:

sliding a first faceplate into two spaced apart longitudinal slots, said two spaced apart longitudinal elements each having a vertex at a first end of both longitudinal elements, wherein the first faceplate visible through an opening in the framework, the framework comprising a base element comprising two ends each having a vertex that are obliquely opposed to both longitudinal element's first ends, said obliquely opposed vertexes interconnecting the two longitudinal elements so as to define an opening, wherein the base elements two ends are each independently connected near the respective first ends of each of the two longitudinal elements as to form two obliquely opposed vertexes connections, a longitudinal slot provided by each of the two longitudinal elements so that the longitudinal slots are coplanar, a top element comprising two ends configured to provide lateral support for the longitudinal elements, the top element disposed downward such that that the plurality of faceplates slides over the top element, the bottom surface of the top element extending below the base component when bottom surface is parallel with the ground surface, the base element extending above the top of the top element when the top element is parallel with the ground surface;

at least one corn bag, wherein said at least one cornhole provided by each plurality of faceplates are configured to allow passage of said at least one corn bag from said top surface to a ground surface;

a base slot provided by the base element so that the base slot is coplanar with the longitudinal slots;

the two spaced apart longitudinal elements each having a 45-degree vertex at the first end of both longitudinal elements;

the two ends of the base end each having a 45-degree vertex;

a leg connected to each of the longitudinal elements configured for propping up a respective second end of each of the two longitudinal elements off of the ground surface;

the legs connected to each of the longitudinal elements, when parallel with the ground surface, configured to be positioned in a recess created by the top element, the longitudinal elements, and the faceplate, the top element when in this position configured to be in contact with the ground surface, the legs when in this position configured to not be in contact with the ground surface.

10. The method of claim 9, further comprising: sliding the first faceplate out from the two spaced apart longitudinal slots.

11. The method of claim 10, further comprising: sliding a second faceplate into the two spaced apart longitudinal slots.

12. The method of claim 11, the framework further comprising at least one corn bag, wherein said at least one cornhole provided by each plurality of faceplates are configured to allow passage of said at least one corn bag from said top surface to a ground surface, a base slot provided by the base element so that the base slot is coplanar with the longitudinal slots, two spaced apart longitudinal elements each having a 45-degree vertex at the first end of both longitudinal elements, the two ends of the base end each having a 45-degree vertex.

* * * * *